US007043813B2

(12) United States Patent
Hanai

(10) Patent No.: US 7,043,813 B2
(45) Date of Patent: May 16, 2006

(54) MANUFACTURING METHOD FOR A SPARK PLUG

(75) Inventor: Takeshi Hanai, Kuwana (JP)

(73) Assignee: Denso Corporation, (JP)

( * ) Notice: Subject to any disclaimer, the term of this patent is extended or adjusted under 35 U.S.C. 154(b) by 266 days.

(21) Appl. No.: 10/685,602

(22) Filed: Oct. 16, 2003

(65) Prior Publication Data

US 2004/0078972 A1 Apr. 29, 2004

(51) Int. Cl.
*H01T 21/02* (2006.01)

(52) U.S. Cl. ..... 29/407.04; 445/7; 445/64; 29/720; 29/458; 313/141; 313/142

(58) Field of Classification Search ..... 445/7
See application file for complete search history.

(56) References Cited

U.S. PATENT DOCUMENTS 4,570,474 A * 2/1986 Tanaka et al. ..... 72/411
6,790,113 B1 * 9/2004 Fujita ..... 445/7

FOREIGN PATENT DOCUMENTS

JP 2000-164320 6/2000

* cited by examiner

*Primary Examiner*—Marc Jimenez
*Assistant Examiner*—Christopher Agrawal
(74) *Attorney, Agent, or Firm*—Nixon & Vanderhye PC

(57) ABSTRACT

In a bond step, one end of ground electrode is bonded to a metallic housing. In a provisional bending step performed after the bonding step, an intermediate portion of the ground electrode is bent with a pressing die so that the other end of the ground electrode is opposed to a distal end surface of a center electrode. In a regular bending step performed after the provisional bending step, the position of the other end of the ground electrode is adjusted so as to adjust the dimension of a spark gap. Receiving dies are prepared for regulating a shift range of a distal end surface of the other end of the ground electrode in a direction perpendicular to an axial line of the center electrode in the process of bending the intermediate portion of the ground electrode in the provisional bending step. In the provisional bending step, the intermediate portion of the ground electrode is bent until the distal end surface of the other end of the ground electrode is brought into contact with the receiving dies.

4 Claims, 5 Drawing Sheets

MANUFACTURING METHOD FOR A SPARK PLUG

BACKGROUND OF THE INVENTION

This invention relates to a manufacturing method for a spark plug installed in an internal combustion engine of an automotive vehicle or the like.

A conventional spark plug has a columnar center electrode insulated and held inside a metal housing and a ground electrode having one end being bonded to the housing, wherein the ground electrode is bent at its intermediate portion so that the other end of the ground electrode is opposed to a distal end surface of the center electrode.

A spacer is used for regulating a bending amount in a provisional bending step of the ground electrode, so that a spark gap is suppressed or regulated within a predetermined range at the end of the provisional bending step (refer to Japanese Patent Application Laid-open No. 2000-164320).

However, according to the manufacturing method disclosed in the above-described prior art document, the protruding amount of a distal end surface of the other end of the ground electrode is not constant.

In other words, the unevenness of the protruding amount increases. This is an ignition property deteriorating factor of the spark plug. In this specification, the "protruding amount" is an overhang of the distal end surface of the other end of the ground electrode with respect to the axial line of the center electrode in a direction perpendicular to the axial line of the center electrode.

SUMMARY OF THE INVENTION

In view of the above-described problems, the present invention has a first object to improve dimensional accuracy of the protruding amount. Furthermore, the present invention has a second object to improve dimensional accuracy of both a spark gap and the protruding amount.

In order to accomplish the above and other related objects, the present invention provides a method for manufacturing a spark plug including a columnar center electrode insulated and held inside a metal housing and a ground electrode having one end being bonded to the housing. The ground electrode is bent at its intermediate portion so that the other end of the ground electrode is substantially perpendicular to an axial line of the center electrode. The other end of the ground electrode is opposed to a distal end surface of the center electrode via a predetermined spark gap. The manufacturing method of this invention includes a bonding step, a provisional bending step, and a regular bending step. The bonding step is performed to bond one end of the ground electrode to the housing. After the bonding step, the provisional bending step is performed to bend an intermediate portion of the ground electrode with a pressing die so that the other end of the ground electrode is opposed to a distal end surface of the center electrode. After the provisional bending step, the regular bending step is performed to adjust a position of the other end of the ground electrode so as to adjust the dimension of the spark gap. The receiving dies are prepared for regulating a shift range of a distal end surface of the other end of the ground electrode in a direction perpendicular to the axial line in the process of bending the intermediate portion of the ground electrode in the provisional bending step. And, in the provisional bending step, the intermediate portion of the ground electrode is bent until the distal end surface of the other end of the ground electrode is brought into contact with the receiving dies.

According to this invention, the receiving dies regulate the protruding amount of the other end of the ground electrode in the provisional bending step. Thus, it becomes possible to improve the dimensional accuracy of the protruding amount at the end of the provisional bending step.

Preferably, the position of the pressing die in the axial line in the provisional bending step is determined with reference to the position of the distal end surface of the center electrode.

According to this method, it becomes possible to reduce the unevenness in the size of the spark gap during the provisional bending step. Furthermore, it becomes possible to reduce the dimensional accuracy of both the spark gap and the protruding amount at the end of the provisional bending step.

Preferably, the provisional bending step is performed in a condition that both sides of the ground electrode are clamped by the receiving dies when the ground electrode is seen from the axial line.

According to this method, the receiving dies prevent the ground electrode from shifting in the lateral direction of (i.e., a direction of the side surfaces of) the ground electrode. Thus, it becomes possible to accurately perform the provisional bending step.

Preferably, the position of the distal end surface of the center electrode is measured by image processing.

According to the above-described prior art document, the position of the distal end surface of the center electrode is measured by laser. However, laser is disadvantageous in that the depth of field is shallow. The measurement based on the laser is adversely influenced by surface conditions (flatness, cutout, etc.) of the distal end surface of the center electrode or unevenness in the position of the distal end surface of the center electrode. Thus, the measurement based on the laser is inaccurate.

On the other hand, according to the above method, the position of the distal end surface of the center electrode is measured by image processing. Thus, it becomes possible to perform accurate measurement without being influenced by the surface conditions of the distal end surface of the center electrode or by the unevenness in the position of the distal end surface of the center electrode.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

A preferred embodiment of the present invention will be explained hereinafter with reference to attached drawings.

FIGS. 1 to 8 are views showing a preferred embodiment of the present invention.

Figure 1:
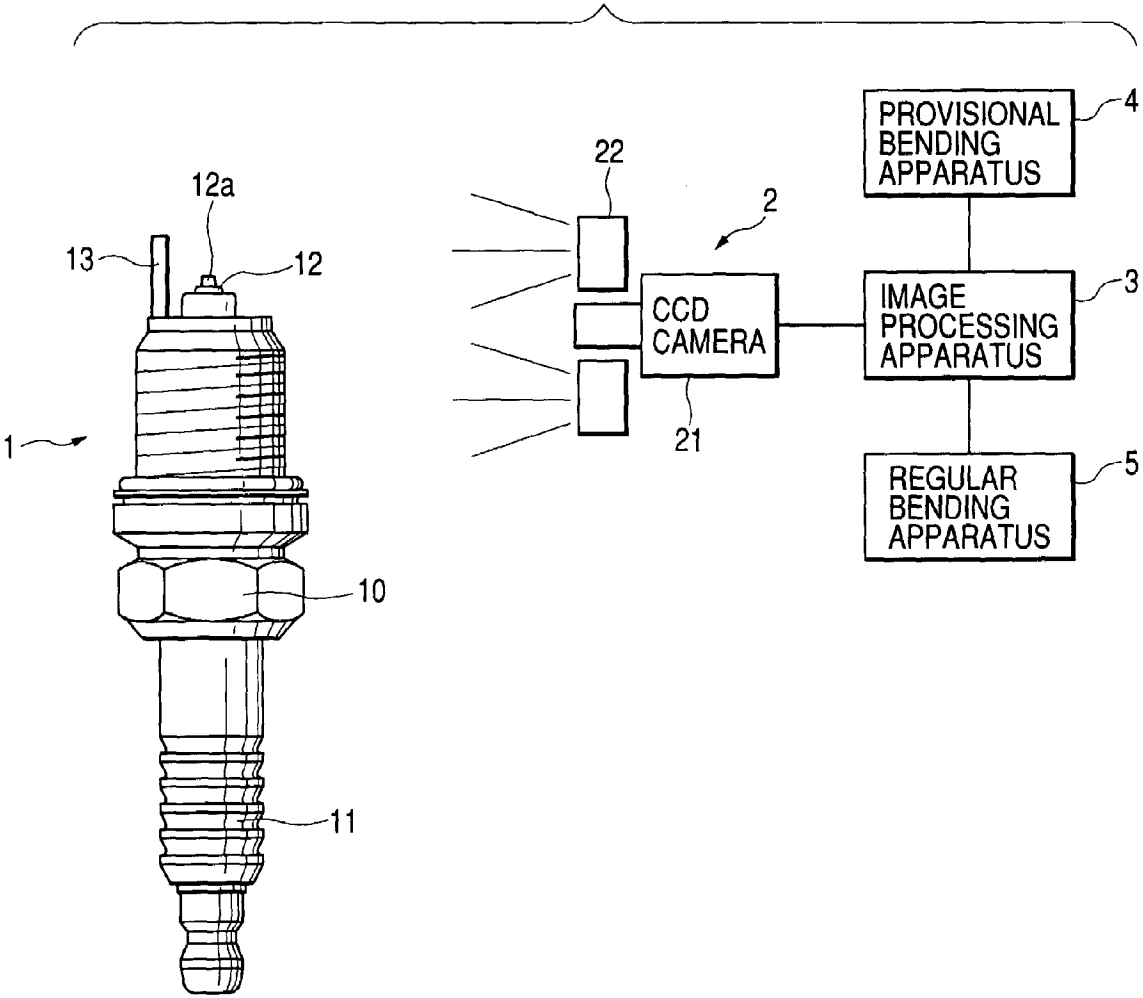
FIG. 1 is a schematic view showing an overall arrangement of a manufacturing apparatus used in embodying this invention.
Figure 2:
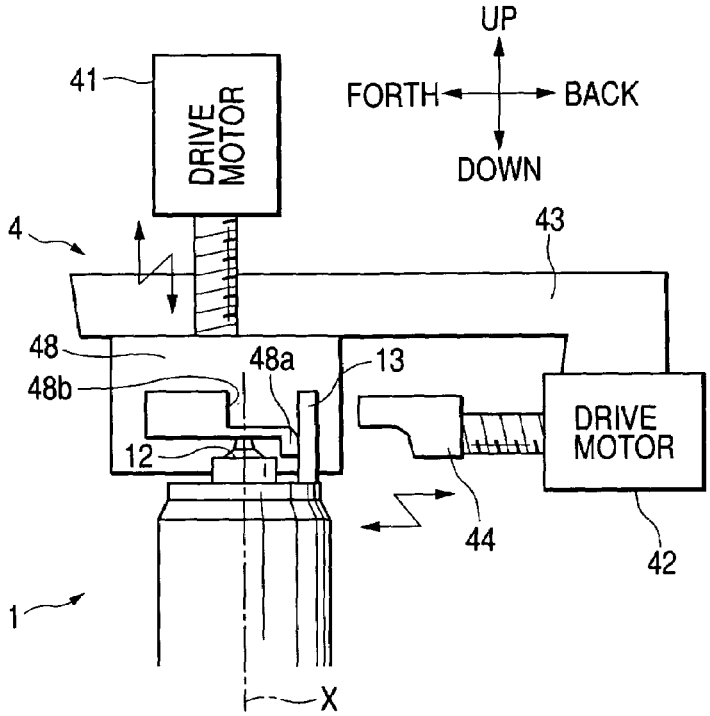
FIG. 2 is a side view showing a provisional bending apparatus shown in FIG. 1, at the time a provisional bending operation is started.

In FIG. 1, a spark plug 1 has a housing 10 made of an electrically conductive steel material and configured into a substantially cylindrical shape. An insulator 11, made of an insulating ceramic and configured into a substantially cylindrical shape, is inserted and fixed in the metallic housing 10. A center electrode 12, made of an electrically conductive metallic material and configured into a substantially columnar shape, is inserted and fixed in an axial bore of the insulator 11. A ground electrode 13, made of a Ni-based alloy and configured into a plate-like shape, is bonded to the housing 10.

Figure 7:
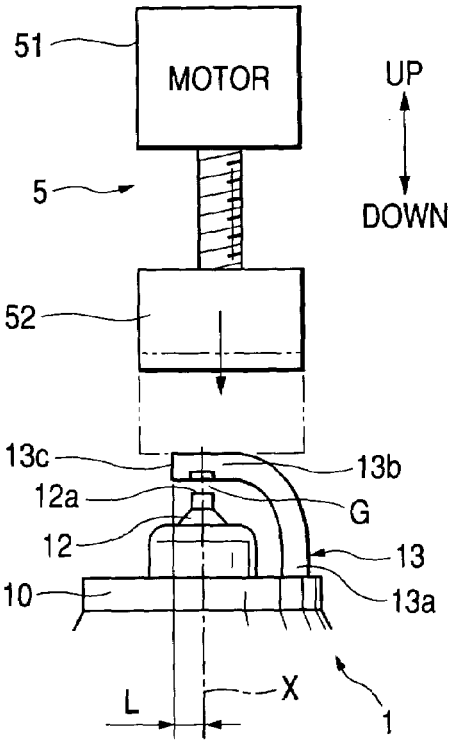
FIG. 7 is a side view showing a regular bending apparatus shown in FIG. 1.
Figure 8:
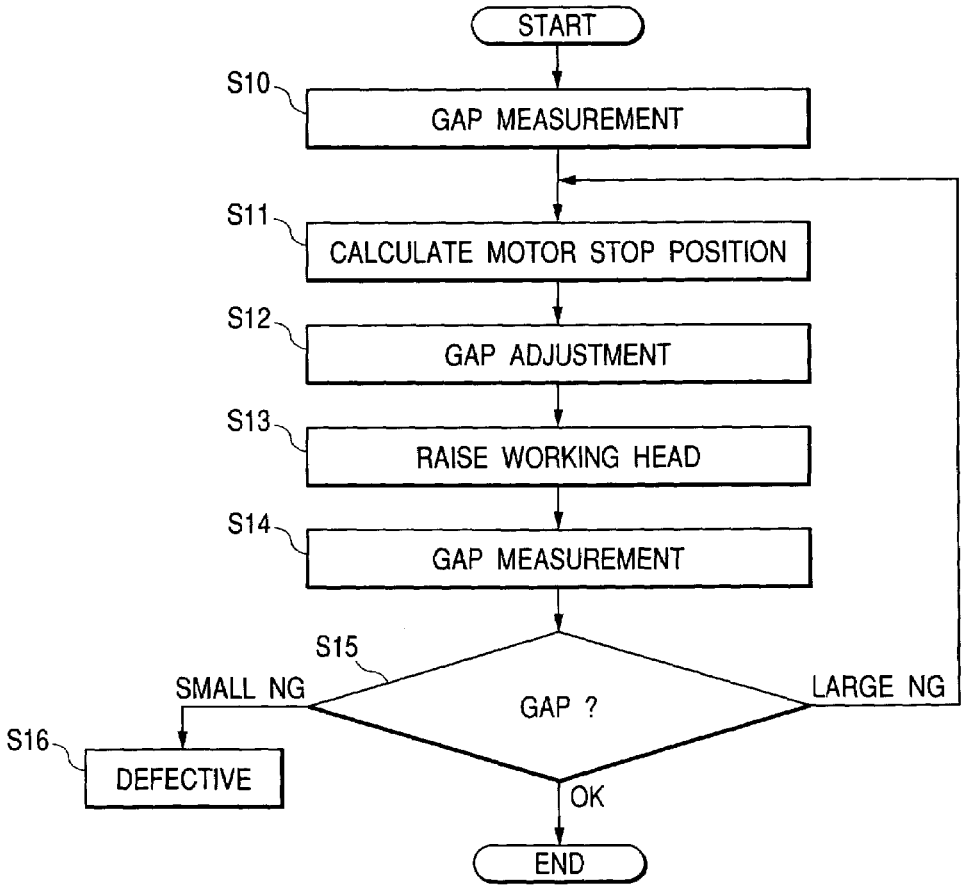
FIG. 8 is a flowchart showing the flow of control processing performed in an image processing apparatus for a regular bending operation.

The ground electrode 13 is straight at the time it is bonded to the housing 10 as shown in FIG. 1, and is processed into a substantially L-shaped configuration through a bending operation (described later in detail) as shown in FIG. 7. More specifically, the ground electrode 13 has a leg portion 13*a* extending substantially parallel to an axial line X of the center electrode 12 and an opposed portion 13*b* extending substantially perpendicularly to the axial line X of the center electrode 12. One end of the leg portion 13*a* is welded to the housing 10. The opposed portion 13*b* is disposed in a confronting relationship with a distal end surface 12*a* of center electrode 12. A spark gap G is provided between the opposed portion 13*b* and the distal end surface 12*a* of center electrode 12. In this invention, the opposed portion 13*b* is also referred to as the other end of the ground electrode 13.

As shown in FIG. 1, a camera unit 2 including a CCD camera 21 and a lighting device 22 is provided in the vicinity of the distal end surface 12*a* of center electrode 12. Image data of the distal end surface 12*a* of center electrode 12, taken by the camera unit 2, is sent to an image processing apparatus 3.

In the provisional bending step, the image processing apparatus 3 measures the position of the distal end surface 12*a* of center electrode 12 based on the image data and determines an operation amount of a provisional bending apparatus 4 (described later in detail) with reference to the position of the distal end surface 12*a* of center electrode 12. Thus, the image processing apparatus 3 controls the operation of the provisional bending apparatus 3.

Furthermore, in the regular bending step, the image processing apparatus 3 measures the dimension of the spark gap G based on the image data, and determines the operation amount of a regular bending apparatus 5 (described later in detail) based on the measured amount of the spark gap G, thereby controlling the operation of the regular bending apparatus 5.

Next, the provisional bending apparatus 4 will be explained with reference to FIGS. 2 to 6. The provisional bending apparatus 4 performing the provisional bending step of bending the ground electrode 13 has two electrically driven motors 41 and 42 whose operations are controlled by the image processing apparatus 3. The first motor 41 drives or actuates a holder 43 in the direction of axial line X (i.e., an up-and-down direction in the drawings).

The second motor 42 is installed on the holder 43. The second motor 42 drives or actuates a pressing die 44 and a cam plate 45 so as to move together in the back-and-forth direction. When the pressing die 44 is moved toward the spark plug 1 (i.e., forward), the pressing die 44 is brought into contact with the ground electrode 13 to bend the intermediate portion of the ground electrode 13 (refer to FIGS. 5 and 6).

A pair of link levers 46 and 47 swing in accordance with the shift movement of the cam plate 45. The cam plate 45 has a pair of cam grooves 45*a*. Pins 46*a* and 47*a*, provided at one end of respective link levers 46 and 47, are slidably inserted into the cam grooves 45*a* of the cam plate 45. Pivot shafts 46*b* and 47*b*, provided at an intermediate portion of respective link levers 46 and 47, are rotatably supported by the holder 43. Receiving dies 48 and 49 are attached to the other end of respective link levers 46 and 47.

Two receiving dies 48 and 49 cooperatively regulate the shape of the ground electrode 13 during the provisional bending operation. To this end, as shown in FIGS. 2 to 5, the receiving dies 48 and 49 have intermediate portion positioning portions 48*a* and 49*a* and distal end surface positioning portions 48*b* and 49*b* provided at their opposed surfaces 48*c* and 49*c*. The intermediate portion positioning portions 48*a* and 49*a* are brought into contact with intermediate portions of the ground electrode 13 during the provisional bending operation. The distal end surface positioning portions 48*b* and 49*b* regulate a forward shift range of a distal end surface 13*c* of the ground electrode 13 so as to regulate a protruding amount L (refer to FIG. 5) during the provisional bending operation.

Figure 3:
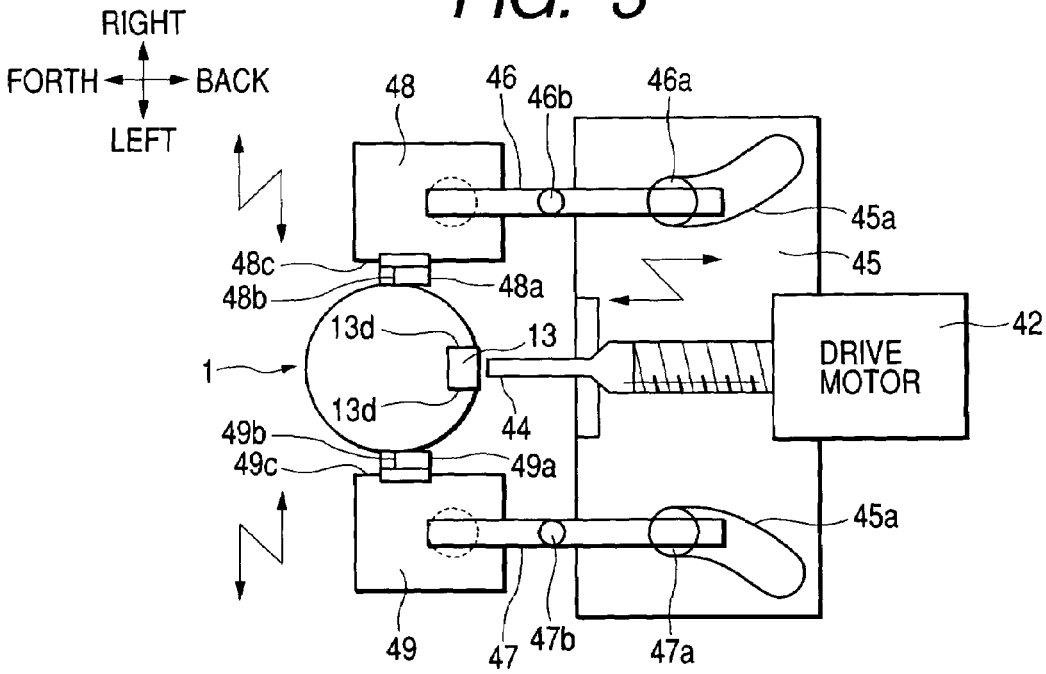
FIG. 3 is a plan view showing the provisional bending apparatus, at the time the provisional bending operation is started.
Figure 4:
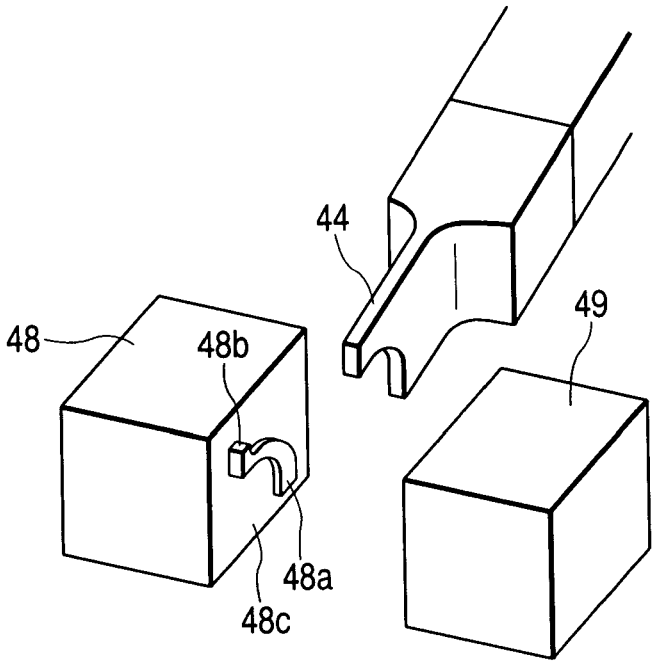
FIG. 4 is a perspective view showing an essential part of the provisional bending apparatus.
Figure 5:
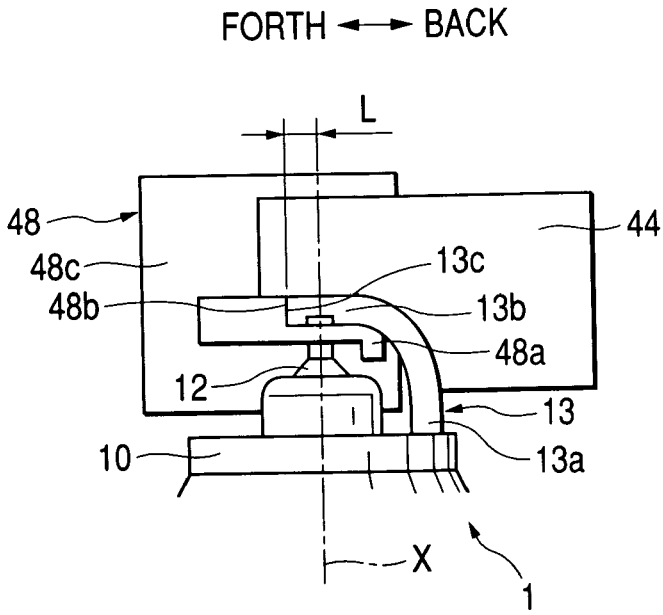
FIG. 5 is a side view showing the essential part of the provisional bending apparatus, at the time the provisional bending operation is finished.
Figure 6:
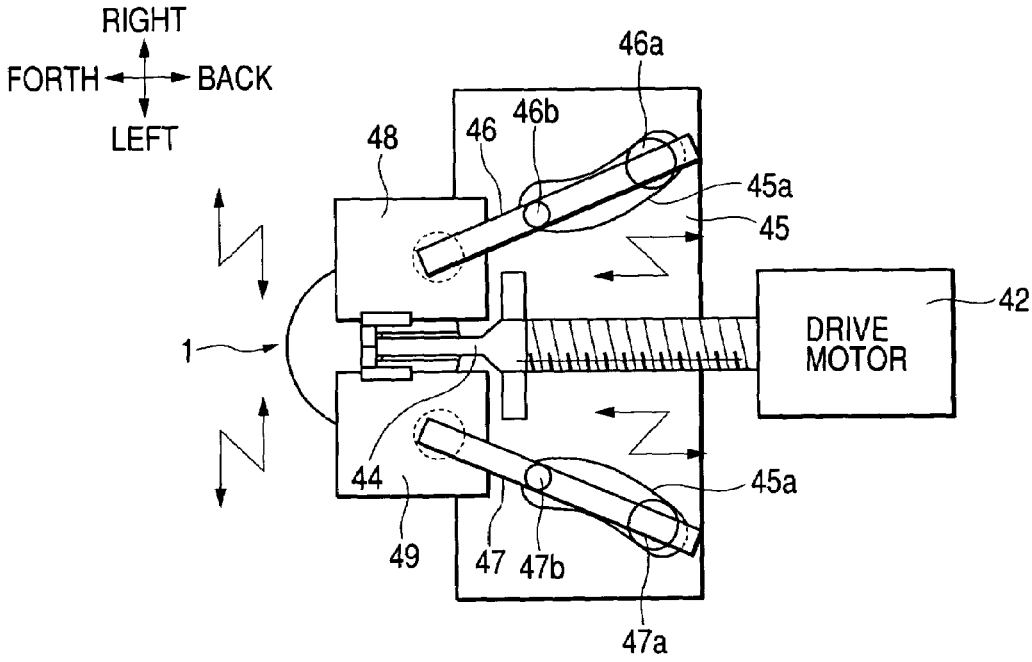
FIG. 6 is a plan view showing the provisional bending apparatus, at the time the provisional bending operation is finished.

In accordance with a shift movement of the pressing die 44 and the cam plate 45 from the bending start position (i.e., the position shown in FIGS. 2 and 3) to the bending end position (i.e., the position shown in FIGS. 5 and 6), the link levers 46 and 47 rotate about their pivot shafts from the condition shown in FIG. 3 to the condition shown in FIG. 6 and accordingly two receiving dies 48 and 49 approach to each other.

In this case, at the time the pressing die 44 is brought into contact with the ground electrode 13, i.e., at the time the operation of bending the ground electrode 13 is started, two receiving dies 48 and 49 are positioned most closely. Two positioning portions 48*a* and 48*b* of the first receiving die 48 are brought into contact with two positioning portions 49*a* and 49*b* of the second receiving die 49.

Furthermore, in the condition that two receiving dies 48 and 49 are positioned most closely, both side surfaces 13*d* (refer to FIG. 3) of ground electrode 13 are sandwiched between the opposed surface 48*c* of first receiving die 48 and the opposed surface 49*c* of second receiving die 49 with tiny clearances, when the ground electrode 13 is seen from the axial line X.

Next, the regular bending apparatus 5 will be explained with reference to FIG. 7. The regular bending apparatus 5 adjusts the position of the opposed portion 13*b* of ground electrode 13 after accomplishing the provisional bending step so as to adjust the dimension of the spark gap G. The regular bending apparatus 5 has an electrically driven motor 51 whose operation is controlled by the image processing apparatus 3. The motor 51 drives a working head 52 in the up-and-down direction.

Next, the processes for manufacturing the ground electrode 13 performed by the above-described manufacturing apparatus will be explained.

<Bonding Step>

First of all, the ground electrode 13 extending straight is bonded to the housing 10. Then, the insulator 11 and the center electrode 12 are assembled in the housing 10 to obtain the spark plug 1 having the arrangement shown in FIG. 1.

<Provisional Bending Step>

After the above-described bonding step, as shown in FIG. 1, the spark plug 1 is held by a holding means (not shown). The CCD camera 21 takes an image of the distal end surface 12*a* of center electrode 12 and its vicinity. The image processing apparatus 3 measures the position of the distal end surface 12*a* of center electrode 12 based on the image data.

Next, the image processing apparatus 3 calculates respective target positions of pressing die 44 and two receiving dies 48 and 49 in the up-and-down direction with reference to the position of the distal end surface 12*a* of center electrode 12. These target positions are determined so that the dimension of the spark gap G becomes equal or close to a predetermined value after the provisional bending operation. Then, by controlling the operation of the first motor 41, the pressing die 44 and two receiving dies 48 and 49 are shifted to their target position in the up-and-down direction (refer to FIGS. 2 and 3).

Next, the image processing apparatus 3 controls the operation of second motor 42 to shift the pressing die 44 and the cam plate 45 forward to the predetermined positions. The link levers 46 and 47 rotate in accordance with the shift movement of the pressing die 44 and the cam plate 45. Two receiving dies 48 and 49 approach to each other in accordance with the rotations of the link levers 46 and 47. At the time the pressing die 44 is brought into contact with the ground electrode 13, two receiving dies 48 and 49 are positioned most closely.

After the pressing die 44 is brought into contact with the ground electrode 13, the pressing die 44 further shifts forward. At this moment, the intermediate portion of ground electrode 13 are clamped between the intermediate portion positioning portion 48*a* of first receiving die 48 and the intermediate portion positioning portion 49*a* of second receiving die 49. Thus, the ground electrode 13 is bent at its intermediate portion being guided by the surfaces of the receiving dies 48 and 49. The opposed portion 13*b* of ground electrode 13 formed through this bending operation extends substantially perpendicularly to the axial line X and is opposed to the distal end surface 12*a* of center electrode 12.

In this case, as shown in FIG. 5, the distal end surface 13*c* of ground electrode 13 is brought into contact with the distal end surface positioning portion 48*b* of first receiving die 48 and the distal end surface positioning portion 49*b* of second receiving die 49. Thus, the forward shift range of the distal end surface 13*c* of ground electrode 13 is regulated by these positioning portions 48*b* and 49*b*. In other words, the protruding amount L is regulated accurately.

Furthermore, the side surfaces 13*d* of the ground electrode 13 are clamped between the opposed surface 48*c* of first receiving die 48 and the opposed surface 49*c* of second receiving die 49. This prevents the ground electrode 13 from shifting in the direction of both side surfaces 13*d*. The direction of both side surfaces 13*d* is a right-and-left direction shown in FIG. 3 or FIG. 6. In other words, the direction of both side surfaces 13*d* is perpendicular to a longitudinal direction of the opposed portion 13*b* of the ground electrode 13 on a surface perpendicular to the axle line X.

<Regular Bending Step>

After the above-described provisional bending step, the dimension of spark gap G is adjusted by using the regular bending apparatus 5 shown in FIG. 7. Hereinafter, the regular bending step will be explained with reference to the flow of control processing shown in FIG. 8.

First, after accomplishing the provisional bending step, the dimension of spark gap G is measured based on the image data obtained from the CCD camera 21 (Step S10). Then, the stop position of the electric motor 51 for lowering the working head 52 is calculated based on the measured value of the spark gap G (Step S11).

Next, the electric motor 51 is operated until it reaches the stop position. In accordance with the operation of the motor 51, the working head 52 is lowered to the predetermined position (indicated by an alternate long and two short dashes line in FIG. 7). The working head 52 presses the opposed portion 13*b* of ground electrode 13 so as to adjust the dimension of spark gap G (Step S12).

Next, the electric motor 51 is rotated in the opposite direction to raise the working head 52 (Step S13). The dimension of spark gap G after accomplishing the regular bending step is measured (Step S14). Then, it is judged as to whether or not the measured value of spark gap G is within an allowable range (Step S15). When the measured value of spark gap G is smaller than the allowable range, this spark plug is excluded as a defective product (Step S16). On the other had, when the measured value of spark gap G is larger than the allowable range, the flow of control processing returns to the step S11 to perform readjustment of spark gap G.

According to the above-described embodiment, the distal end surface positioning portion 48*b* of first receiving die 48 and the distal end surface positioning portion 49*b* of second receiving die 49 cooperatively regulate the protruding amount L of during the provisional bending operation. Thus, it becomes possible to improve the dimensional accuracy in adjusting the protruding amount L in the provisional bending.

Furthermore, the target positions of pressing die 44 and two receiving dies 48 and 49 are determined so that the dimension of the spark gap G after the provisional bending operation becomes equal or close to the predetermined value. This makes it possible to reduce the unevenness of spark gap dimension caused in the provisional bending. Thus, it becomes possible to improve the dimensional accuracy of spark gap G at the time the provisional bending operation is accomplished.

Furthermore, the opposed surface 48*c* of first receiving die 48 and the opposed surface 49*c* of second receiving die 49 clamp the side surfaces 13*d* of ground electrode 13, so as to prevent the ground electrode 13 from shifting in the direction of the side surfaces 13*d*. Thus, it becomes possible to accurately perform the provisional bending operation.

Furthermore, the position of the distal end surface 12*a* of center electrode 12 is measured by image processing. This makes it possible to perform accurate measurement without being influenced by the surface conditions of the distal end surface 12*a* of center electrode 12 or the unevenness in the position of the distal end surface 12*a* of center electrode 12.

What is claimed is:

1. A method for manufacturing a spark plug comprising a center electrode insulated and held inside a housing and a ground electrode having one end being bonded to said housing, wherein said ground electrode is bent at its intermediate portion so that an axial line of said ground electrode at the other end thereof is substantially perpendicular to an axial line of said center electrode, and said other end of said ground electrode is opposed to a distal end surface of said center electrode via a predetermined spark gap, said manufacturing method comprising:

a bonding step of bonding one end of said ground electrode to said housing;

a provisional bending step, performed after said bonding step, of bending an intermediate portion of said ground electrode with a pressing die so that the other end of said ground electrode is opposed to the distal end surface of said center electrode; and a regular bending step, performed after said provisional bending step, of adjusting a position of the other end of said ground electrode so as to adjust the dimension of said spark gap, wherein a protruding amount of a distal end surface of said other end of said ground electrode in a direction perpendicular to said axial line of said center electrode is regulated by a receiving die in the process of bending the intermediate portion of said ground electrode in said provisional bending step, wherein the protruding amount is defined as a distance between said distal end surface of said ground electrode and an imaginary axial extension of said center electrode, measured in said direction perpendicular to said axial line of said center electrode, in said provisional bending step, said intermediate portion of said ground electrode is bent until said distal end surface of said other end of said ground electrode is brought into contact with said receiving die, and said distal end surface of said ground electrode, in contact with the receiving die, is protruded from said center electrode by said protruding amount.

2. The manufacturing method for a spark plug in accordance with claim 1, wherein the position of said pressing die in said axial line in said provisional bending step is determined with reference to the position of said distal end surface of said center electrode.

3. The manufacturing method for a spark plug in accordance with claim 1, wherein said provisional bending step is performed in a condition that both sides of said ground electrode are clamped by said receiving dies when said ground electrode is seen from said axial line.

4. The manufacturing method for a spark plug in accordance with claim 2, wherein the position of said distal end surface of said center electrode is measured by image processing.

* * * * *

UNITED STATES PATENT AND TRADEMARK OFFICE

CERTIFICATE OF CORRECTION

PATENT NO. : 7,043,813 B2
APPLICATION NO. : 10/685602
DATED : May 16, 2006
INVENTOR(S) : Hanai, Takeshi It is certified that error appears in the above-identified patent and that said Letters Patent is hereby corrected as shown below:

On the Title Page, before Section (51), the following Priority Data has been added:

-- (30) Foreign Application Priority Data

Oct. 22, 2002 [JP].....2002-306915 --

Signed and Sealed this

Twenty-ninth Day of August, 2006

JON W. DUDAS
*Director of the United States Patent and Trademark Office*